US008802338B2

(12) United States Patent
Nukada et al.

(10) Patent No.: US 8,802,338 B2
(45) **Date of Patent: *Aug. 12, 2014**

(54) ELECTROPHOTOGRAPHIC PHOTORECEPTOR, PROCESS CARTRIDGE AND IMAGE FORMING APPARATUS

(75) Inventors: Hidemi Nukada, Kanagawa (JP); Takahiro Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 749 days.

This patent is subject to a terminal disclaimer.

(21) Appl. No.: 12/557,175

(22) Filed: Sep. 10, 2009

(65) Prior Publication Data

US 2010/0248105 A1 Sep. 30, 2010

(30) Foreign Application Priority Data

Mar. 27, 2009 (JP) ..... 2009-078291

(51) Int. Cl.
*G03G 15/00* (2006.01)

(52) U.S. Cl.
USPC ..... 430/66; 399/111; 399/159

(58) Field of Classification Search
USPC ..... 430/66; 399/11, 159
See application file for complete search history.

(56) References Cited

U.S. PATENT DOCUMENTS

| | | | | |
|---|---|---|---|---|
| 2008/0199795 | A1 | 8/2008 | Ogaki et al. | |
| 2009/0130576 | A1 | 5/2009 | Ogaki et al. | |
| 2009/0232551 | A1* | 9/2009 | Nagao et al. | 399/159 |
| 2010/0248100 | A1* | 9/2010 | Ezumi | 430/56 |

FOREIGN PATENT DOCUMENTS

| | | |
|---|---|---|
| JP | A-58-164656 | 9/1983 |
| JP | A 63-221355 | 9/1988 |
| JP | A-63-221355 | 9/1988 |
| JP | A 06-230591 | 8/1994 |
| JP | A 06-332219 | 12/1994 |
| JP | A 07-134435 | 5/1995 |
| JP | A 07-295276 | 11/1995 |
| JP | A 08-062883 | 3/1996 |
| JP | A-08-062883 | 3/1996 |
| JP | A 2000-275889 | 10/2000 |
| JP | A 2003-195541 | 7/2003 |
| JP | A-2006-330713 | 12/2006 |
| WO | WO 2008/053904 A1 | 5/2008 |

OTHER PUBLICATIONS

Yamashita et al., "Macromonomer No Kagaku to Kogyo," *Macromonomer Chemistry and Industry*, 1989, pp. 57-59, IPC Publishing Section (partial English Translation).

Japanese Office Action issued in Japanese Application No. 2009-078291 dated Aug. 16, 2011 (with translation).

May 10, 2012 Office Action issued in Japanese Patent Application No. 200910204738.9 (with translation).

(Continued)

*Primary Examiner* — Mark F Huff
*Assistant Examiner* — Rachel Zhang
(74) *Attorney, Agent, or Firm* — Oliff PLC

(57) ABSTRACT

The present invention provides an electrophotographic photoreceptor that includes: at least a photosensitive layer on a conductive support; a surface layer that contains fluororesin particles and a fluorocarbon comb graft polymer containing a repeating unit derived from a macromonomer and a repeating unit derived from a monomer having a fluoroalkyl group having 1 to 8 carbon atoms; wherein the surface layer contains phosphorus in an amount of about 5 ppm or less, and a process cartridge and electrophotographic apparatus, which use the photoreceptor.

14 Claims, 3 Drawing Sheets

(56) References Cited

OTHER PUBLICATIONS

May 10, 2012 Office Action issued in Chinese Patent Application No. 200910204738.9 (with translation).

Office Action issued Dec. 8, 2011 in related U.S. Appl. No. 12/545,506.

U.S. Appl. No. 12/545,506, filed Aug. 21, 2009.

* cited by examiner

ELECTROPHOTOGRAPHIC PHOTORECEPTOR, PROCESS CARTRIDGE AND IMAGE FORMING APPARATUS

CROSS-REFERENCE TO RELATED APPLICATION

This application is based on and claims priority under 35 USC 119 from Japanese Patent Application No. 2009-078291 filed on Mar. 27, 2009.

BACKGROUND

1. Technical Field

The present invention relates to an electrophotographic photoreceptor, a process cartridge and an image forming apparatus.

2. Related Art

The electrophotographic image formation has advantages such as high-speed and high printing quality; accordingly, it is in wide use in a field of a copy machine and a laser beam printer. As an electrophotographic photoreceptor used in an electrophotographic apparatus (hereinafter, in some cases, simply referred to as "photoreceptor"), an electrophotographic photoreceptor that uses an organic photoconductive material that is less expensive and more excellent in the productivity and disposability than a photoreceptor that uses an inorganic photoconductive material forms a mainstream. Among these, a function-separated organic photoreceptor in which a charge generating layer that generates charges upon exposure and a charge transporting layer that transports charges are laminated is excellent in the electrophotographic characteristics; accordingly, the function-separated organic photoreceptor is proposed variously and put into practical use.

A method of improving the endurance of a photosensitive layer has been studied. For example, a method where fluororesin particles are dispersed in a surface layer to reduce surface energy of a surface layer of the photoreceptor and a method where zinc stearate is coated on a surface of a photoreceptor to reduce surface energy of a photoreceptor have been proposed.

SUMMARY

According to an aspect of the invention, an electrophotographic photoreceptor comprising at least a photosensitive layer on a conductive support, a surface layer of the electrophotographic photoreceptor comprising fluororesin particles and a fluorocarbon comb graft polymer containing a repeating unit derived from a macromonomer and a repeating unit derived from a monomer having a fluoroalkyl group having 1 to 8 carbon atoms, and the surface layer containing phosphorus in an amount of about 5 ppm or less.

BRIEF DESCRIPTION OF THE DRAWINGS

Exemplary embodiments of the present invention will be described in detail based on the following figures, wherein.

DETAILED DESCRIPTION

Figure 1:
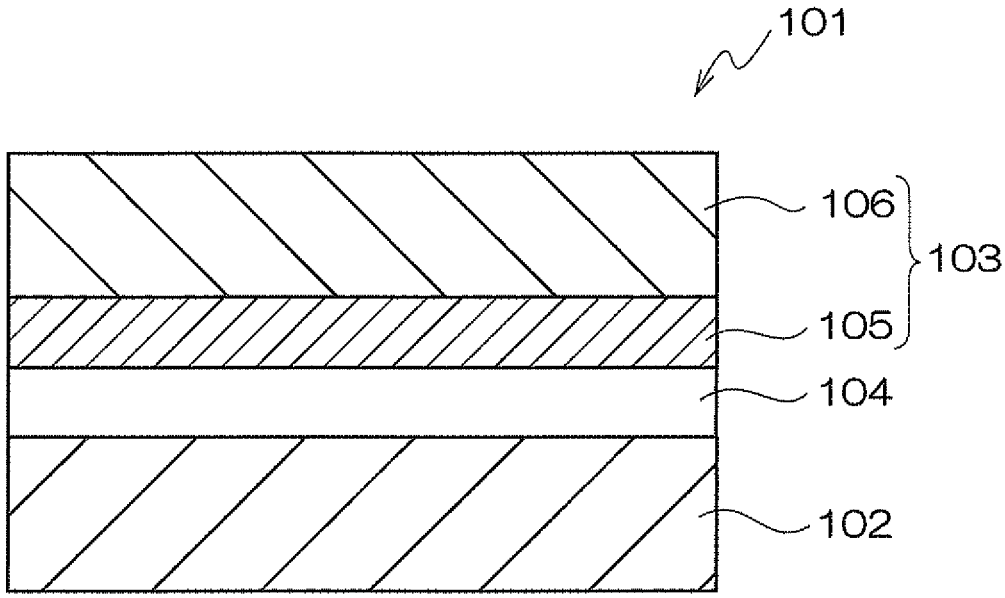
FIG. 1 is a schematic sectional diagram showing one example of an electrophotographic photoreceptor involving the exemplary embodiment.

According to exemplary embodiments of an electrophotographic photoreceptor, a process cartridge and an image forming apparatus of the invention will be detailed.

<Electrophotographic Photoreceptor>

An electrophotographic photoreceptor involving an exemplary embodiment of the invention includes at least a photosensitive layer on a conductive support, a surface layer thereof that includes fluororesin particles and a fluorocarbon comb graft polymer containing a repeating unit derived from a macromonomer and a repeating unit derived from a monomer having a fluoroalkyl group having 1 to 8 carbon atoms, and phosphorus that is contained in the surface layer by 5 ppm (or about 5 ppm) or less.

In the exemplary embodiment, the macromonomer means a straight chain polymer having a polymerizable functional group at one end of a molecular chain. Furthermore, the "conductive" means that the volume resistivity is less than $10^7$ Ω·cm.

A content of phosphorus in the surface layer in the exemplary embodiment means a value measured according to a method shown below.

That is, a surface layer of a photoreceptor is peeled and dissolved in toluene, the resulted toluene solution and distilled water are rigorously stirred, and thereafter a toluene phase and an aqueous phase are separated. Phosphorus is detected from the resulted aqueous phase by ion chromatography.

Inventors have studied a fluorocarbon comb graft polymer and obtained a finding that a phenomenon where the density is lowered owing to a rise of the residual potential is caused when a residual catalyst in the fluorocarbon comb graft polymer that is used as a dispersing aid for dispersing fluororesin particles forms a trap. More specifically, as a catalyst used in the course of producing a macromonomer that is one of raw materials of the fluorocarbon comb graft polymer, an ammonium salt is used frequently. It is difficult to efficiently reduce an ammonium salt by purification after a macromonomer is graft polymerized with a fluorocarbon monomer, that is, a trace of an ammonium salt tends to remain. The remained catalyst is present on a surface layer of a photoreceptor and becomes a causative agent that develops a trap site where a charge is stored. Accordingly, when the photoreceptor is repeatedly used under high temperature and high humidity, the density tends to be lowered owing to a rise of the residual potential.

This time, after studying hard catalyst species used in the course of producing a macromonomer, it was found that when a phosphorus-containing compound (preferably, a phosphonium compound) is used as a catalyst, the residual potential becomes difficult to rise. In the exemplary embodiment, phosphorus contained in a surface layer is derived mainly from a catalyst used in the course of producing a macromonomer.

In the exemplary embodiment, a content of phosphorus in a surface layer is preferably 5 ppm (or about 5 ppm) or less and more preferably 3 ppm (or about 3 ppm) or less.

In what follows, an electrophotographic photoreceptor involving the exemplary embodiment will be detailed based on drawings.

FIG. 1 is a schematic sectional diagram showing a suitable exemplary embodiment of an electrophotographic photoreceptor of the exemplary embodiment. An electrophotographic photoreceptor 101 shown in FIG. 1 includes a function-separated photosensitive layer 103 in which a charge generating layer 105 and a charge transporting layer 106 are separately disposed, and has a structure where an undercoat layer 104, a charge generating layer 105 and a charge transporting layer 106 are sequentially coated in this order on a conductive support 102. Herein, the charge generating layer 106 is a surface layer (a layer disposed on a side remotest from the support 102) in the photoreceptor 101 and constituted containing fluororesin particles and a fluorocarbon comb graft polymer, which will be detailed below.

In what follows, respective constituents of the electrophotographic photoreceptor 101 will be described.

As the conductive support 102, any one of existing conductive supports may be used. Examples thereof include, for example, metals such as aluminum, nickel, chromium, and stainless steel, plastic films on which a thin film of any one of aluminum, titanium, nickel, chromium, stainless steel, gold, vanadium, tin oxide, indium oxide and ITO is disposed, papers coated or impregnated with a conductivity-imparting agent, and plastic films. A shape of the conductive support 102 may be a sheet shape or a plate shape without restricting to a drum shape.

When a metal pipe is used as the conductive support 102, a surface thereof may be as it is produced, or may be treated in advance by mirror grinding, etching, anodic oxidation, rough grinding, centerless grinding, sand blasting or wet homing.

The undercoat layer 104 is disposed, as required, for the purpose of inhibiting light from reflecting on a surface of a conductive support 102 and of inhibiting unnecessary carriers from flowing in from the conductive support 102 to the photosensitive layer 103. Examples of a material of the undercoat layer 104 include those obtained in such a manner that powder of metal such as aluminum, copper, nickel or silver, conductive metal oxide such as antimony oxide, indium oxide, tin oxide or zinc oxide, or a conductive material such as carbon fiber, carbon black or graphite powder is dispersed in a binder resin, followed by coating on a support. Furthermore, particles of metal oxides may be used by mixing at least two kinds thereof. Still furthermore, powder resistance may be controlled by surface treating particles of metal oxide with a coupling agent.

Examples of the binder resin contained in the undercoat layer 104 include existing polymer resin compounds such as an acetal resin such as polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, and a urethane resin. A charge transporting resin having a charge transporting group and a conductive resin such as polyaniline may be used as well. Among these, a resin insoluble in a coating solvent of a top layer is preferably used. A phenol resin, a phenol-formaldehyde resin, a melamine resin, a urethane resin and an epoxy resin are preferably used.

A ratio of particles of metal oxide and a binder resin in the undercoat layer 104 may be set in a range where desired electrophotographic photoreceptor characteristics are obtained without particular restriction.

When the undercoat layer 104 is formed, a coating solution obtained by adding the components to a solvent is used. Examples of such solvent include organic solvents, for example, an aromatic hydrocarbon solvent such as toluene or chlorobenzene, an aliphatic alcohol solvent such as methanol, ethanol, n-propanol, iso-propanol, or n-butanol, a ketone solvent such as acetone, cyclohexanone or 2-butanone, a halogenated aliphatic hydrocarbon solvent such as methylene chloride, chloroform or ethylene chloride, a cyclic or straight ether solvent such as tetrahydrofuran, dioxane, ethylene glycol or diethyl ether, and an ester solvent such as methyl acetate, ethyl acetate, or n-butyl acetate. The solvents may be used singularly or in a combination of at least two kinds thereof. When the solvents are mixed, as solvents used, any one of the solvents may be used as long as a mixed solvent is capable of dissolving a binder resin.

As a method of dispersing particles of metal oxide in a undercoat layer-forming coating solution, a media dispersing device such as a ball mill, a vibration ball mill, an attritor, a sand mill, or a horizontal sand mill, or a media-less dispersing device such as a stirrer, an ultrasonic dispersing device, a roll mill, or a high-pressure homogenizer may be used. As the high-pressure homogenizer, a collision type where a dispersion liquid is dispersed by liquid-liquid collision or liquid-wall collision under high pressure and a penetration method where a dispersion liquid is forced to go through fine flow paths under high pressure to disperse are cited.

Examples of a method of coating thus-obtained undercoat layer-forming coating solution on the support 102 include a dip coating method, a push-up coating method, a wire bar coating method, a spray coating method, a blade coating method, a knife coating method and a curtain coating method. A film thickness of the undercoat layer 104 is preferably 15 μm or more and more preferably 20 μm or more and 50 μm or less. In the undercoat layer 104, particles of a resin may be added in the undercoat layer to control the surface roughness. As the resin particles, silicone resin particles, or crosslinked polymethyl methacrylate resin particles may be used.

Furthermore, a surface of the undercoat layer 104 may be polished to control the surface roughness. Examples of the polishing method include a buff polishing method, a sand blast polishing method, a wet homing method and a grinding method.

Furthermore, though not shown in the drawing, an intermediate layer may be further disposed on the undercoat layer 104 for the purpose of improving electric characteristics, image quality, image quality maintainability and adhesiveness of the photosensitive layer. Examples of the binder resin used in the intermediate layer include organometallic compounds containing zirconium, titanium, aluminum, manganese or silicon, other than polymer resin compounds such as an acetal resin such as polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, and a melamine resin. These compounds may be used singularly or in a mixture or polycondensate of a plurality of compounds. Among these, an organometallic compound containing zirconium or silicon is excellent in the performance such that the residual potential is low, the potential variation caused by an environment is less, and a potential variation caused by repeating usage is less.

Examples of the solvent used in the intermediate layer include existing organic solvents, for example, an aromatic hydrocarbon solvent such as toluene or chlorobenzene, an aliphatic alcohol solvent such as methanol, ethanol, n-propanol, iso-propanol, or n-butanol, a ketone solvent such as acetone, cyclohexanone or 2-butanone, a halogenated aliphatic hydrocarbon solvent such as methylene chloride, chloroform or ethylene chloride, a cyclic or straight ether solvent such as tetrahydrofuran, dioxane, ethylene glycol or diethyl ether, and an ester solvent such as methyl acetate, ethyl acetate, or n-butyl acetate. These solvents may be used singularly or in a combination of at least two kinds thereof. When the solvents are mixed, as the solvent used, any one of the solvents may be used as long as a mixed solvent thereof is capable of dissolving a binder resin.

Examples of a coating method of forming an intermediate layer include a dip coating method, a push-up coating method, a wire bar coating method, a spray coating method, a blade coating method, a knife coating method and a curtain coating method.

The intermediate layer plays as well a role of an electric blocking layer other than a role of improving the coating property of a top layer. However, when a film thickness thereof is excessively large, an electric barrier becomes excessively strong and thereby desensitization or a rise of the potential caused by repeating usage may be caused. Accordingly, when an intermediate layer is formed, a film thickness is set in the range of 0.1 μm or more and 3 μm or less. Furthermore, the intermediate layer in this case may be used as the undercoat layer 104.

The charge generating layer 105 is formed by dispersing a charge generating material in an appropriate binder resin. Examples of the charge generating material include phthalocyanine dyes such as metal-free phthalocyanine, chlorogallium phthalocyanine, hydroxygallium phthalocyanine, dichlorotin phthalocyanine and titanyl phthalocyanine. In particular, a chlorogallium phthalocyanine crystal having strong diffraction peaks at least at 7.4°, 16.6°, 25.5° and 28.3° by a Bragg angle (2θ±0.2°) to CuKα characteristic X-ray, a metal-free phthalocyanine crystal having strong diffraction peaks at least at 7.7°, 9.3°, 16.9°, 17.5°, 22.4° and 28.8° by a Bragg angle (2θ±0.2°) to CuKα characteristic X-ray, a hydroxygallium phthalocyanine crystal having strong diffraction peaks at least at 7.5°, 9.9°, 12.5°, 16.3°, 18.6°, 25.1° and 28.3° by a Bragg angle (2θ±0.2°) to CuKα characteristic X-ray, and a titanyl phthalocyanine crystal having strong diffraction peaks at least at 9.6°, 24.1°, and 27.2° by a Bragg angle (2θ±0.2°) to CuKα characteristic X-ray may be used. In addition to the above, as the charge generating material, a quinoline dye, a perylene dye, an indigo dye, a bisbenzoimidazole dye, an anthrone dye and a quinacridone dye may be used. These charge generating materials may be used singularly or in a combination of at least two kinds thereof.

Examples of the binder resin in the charge generating layer 105 include, for example, a polycarbonate resin such as a bisphenol A or bisphenol Z polycarbonate resin, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate resin, a vinyl chloride-vinyl acetate-maleic anhydride resin, a silicone resin, a phenol-formaldehyde resin, a polyacrylamide resin, a polyamide resin, and a poly-N-vinylcarbazole resin. The binder resins may be used singularly or in a combination of at least two kinds thereof. A blending ratio of the charge generating material and the binder resin is desirably in the range from 10:1 to 1:10.

When the charge generating layer 105 is formed, a coating solution obtained by adding the foregoing components to the solvent is used. Examples of the solvent include organic solvents, for example, an aromatic hydrocarbon solvent such as toluene or chlorobenzene, an aliphatic alcohol solvent such as methanol, ethanol, n-propanol, iso-propanol, or n-butanol, a ketone solvent such as acetone, cyclohexanone or 2-butanone, a halogenated aliphatic hydrocarbon solvent such as methylene chloride, chloroform or ethylene chloride, a cyclic or straight ether solvent such as tetrahydrofuran, dioxane, ethylene glycol or diethyl ether and an ester solvent such as methyl acetate, ethyl acetate, or n-butyl acetate. These solvents may be used singularly or in a combination of at least two kinds thereof. When the solvents are mixed, as the solvent used, any one of the solvents may be used as long as a mixed solvent thereof is capable of dissolving a binder resin.

A coating solution is subjected to a dispersing process to disperse the charge generating material in the resin. Examples of a dispersing method include media dispersing devices such as a ball mill, a vibration ball mill, an attritor, a sand mill, and a horizontal sand mill, and media-less dispersing devices such as a stirrer, an ultrasonic dispersing device, a roll mill, and a high-pressure homogenizer. Examples of the high-pressure homogenizer include a collision type where a dispersion liquid is dispersed by liquid-liquid collision or liquid-wall collision under high pressure and a penetration method where a dispersion liquid is forced to go through fine flow paths under high pressure to disperse.

Examples of a method of coating thus-obtained coating solution on the undercoat layer 104 include a dip coating method, a push-up coating method, a wire bar coating method, a spray coating method, a blade coating method, a knife coating method and a curtain coating method. A film thickness of the charge generating layer 105 is set in the range preferably of 0.01 μm or more and 5 μm or less and more preferably of 0.05 μm or more and 2.0 μm or less.

A charge transporting layer 106 is, as mentioned above, a layer including fluororesin particles and a fluorocarbon comb graft polymer containing a repeating unit derived from a macromonomer and a repeating unit derived from a monomer having a fluoroalkyl group having 1 or more and 8 or less carbon atoms.

The fluorocarbon comb graft polymer according to the exemplary embodiment of the invention is obtained by copolymerizing a macromonomer that is a straight chain polymer having a polymerizable functional group at one end of the molecule chain and a polymerizable monomer (hereinafter, in some cases, referred to as a polymerizable fluoromonomer) having a fluoroalkyl group having 1 to 8 carbon atoms.

Examples of the macromonomer include polymers and copolymers of acrylic acid esters, methacrylic acid esters, styrene compounds or the like. As a catalyst used when the macromonomer is synthesized, a phosphorus-containing compound (preferably a phosphonium compound) is used.

The phosphonium compound is not particularly limited as long as desired characteristics are obtained. At least one kind of compound selected from the group consisting of a triphenylphosphonium salt compound, a tetraphenylphosphonium salt compound, a tributylphosphonium salt compound, and a tetrabutylphosphonium salt compound is preferably used. In the exemplary embodiment, phosphorus contained in the surface layer may be derived from at least one kind of compound selected from the group consisting of a triphenylphosphonium salt compound, a teraphenylphosphonium salt compound, a tributylphosphonium salt compound, and a tetrabutylphosphonium salt compound.

Examples of the polymerizable fluoromonomer having a fluoroalkyl group having 1 to 8 carbon atoms include perfluoroalkylethyl methacrylate and perfluoroalkyl methacrylate.

A polymerization ratio of a macromonomer to a polymerizable fluoromonomer is not particularly limited as long as the ratio is in a range that allows desired characteristics to be obtained. However, a content of fluorine in the molecule of the fluorocarbon comb graft polymer is preferably from 10% (or about 10%) by weight to 40% (or about 40%) by weight and more preferably from 10% (or about 10%) by weight to 30% (or about 30%) by weight. When the content of fluorine in the molecule is less than 10% by weight, absorptivity of the fluorocarbon comb graft polymer to the fluororesin particles tends to be lowered to result in the occurrence of failure in dispersion of the fluororesin particles. When the content of fluorine in the molecule exceeds 40% by weight, solubility of the fluorocarbon comb graft polymer in a solvent is lowered to result in difficulty in using it as a dispersion aid.

A molecular weight of the fluorocarbon comb graft polymer is not particularly limited as far as the molecular weight is within a range that allows desired characteristics to be obtained. However, a number average molecular weight of the fluorocarbon comb graft polymer in terms of polystyrene is preferably from 5,000 (or about 5,000) to 20,000 (or about 20,000) and more preferably from 6,000 (or about 6,000) to 15,000 (or about 15,000). When the number average molecular weight in terms of polystyrene is less than 5,000, the number of the fluorocarbon comb graft polymers adsorbed to the fluororesin particles is insufficient to maintain excellent dispersion, whereby dispersion failure easily occurs. Furthermore, when the number average molecular weight in terms of polystyrene is larger than 20,000, the solvent solubility of the fluorocarbon comb graft polymer is lowered to result in difficulty in using it as a dispersion aid.

The fluorocarbon comb graft polymer is preferably contained in the surface layer in an amount of preferably from 0.5% (or about 0.5%) by weight to 5% (or about 5%) by weight and more preferably from 1% (or about 1%) by weight to 4% (or about 4%) by weight, with respect to the weight of the fluororesin particles. When an addition amount of the fluorocarbon comb graft polymer with respect to the weight of the fluororesin particles is less than 0.5% by weight, the fluororesin particles are insufficiently dispersed in some cases. When the addition amount thereof exceeds 5% by weight, the fluorocarbon comb graft polymer that is not adsorbed on a surface of the fluororesin particles and that is excessive with respect to the fluorocarbon comb graft polymer that is adsorbed on a surface of the fluororesin particles to function as a dispersion aid is present in a charge transporting layer 106, and thereby, trap sites where charges are stored are developed. As a result, the residual potential rises when used repeatedly under high temperature and high humidity to result in a photoreceptor in which density reduction is likely to occur in some cases.

The fluorocarbon comb graft polymer may be a polymer containing a repeating unit represented by the following Structural Formula A and a repeating unit represented by the following Structural Formula B.

Structural Formula A

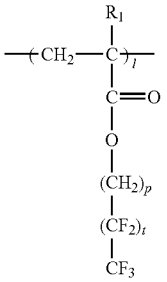

-continued

Structural Formula B

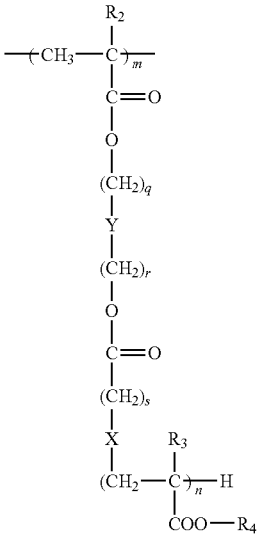

In Structural Formulas A and B, l, m and n each independently represent an integer of 1 or more; p, q, r and s each independently represent 0 or an integer of 1 or more; t represents an integer of 1 to 7; $R_1$, $R_2$, $R_3$ and $R_4$ each independently represent a hydrogen atom or an alkyl group; X represents an alkylene group, a halogen-substituted alkylene group, —S—, —O—, —NH— or a single bond; and Y represents an alkylene group, a halogen-substituted alkylene group, —($C_zH_{2z-1}$(OH))— or a single bond. Z represents an integer of 1 or more.

(Synthesis Method of Fluorocarbon Comb Graft Polymer)

For example, concerning the synthesis method of the macromonomer of Structural Formula B of the present application, known techniques such as a method disclosed in JP-A No. 58-164656 and various methods described in "Macromonomer no Kagaku to Kogyo" (Macromonomer Chemistry and Industry), published by IPC, Yuya Yamashita et. al., 1989) may be used.

In what follows, an example of the production method of the macromonomer of Structural Formula B is described.

To an alkyl acrylate monomer or an alkyl methacrylate monomer which is a raw material of the polymer having a repeating structural unit of Structural Formula B, a polymerization initiator in an amount of 1 part by weight to 10 parts by weight based on the monomer, and a chain transfer agent in an amount of 1 part by weight to 10 parts by weight based on the monomer are added to perform polymerization, whereby an alkyl acrylate polymer or alkyl methacrylate polymer in which the chain transfer agent is bonded at the terminal is obtained. To the obtained alkyl acrylate polymer or alkyl methacrylate polymer, 0.1 parts by weight to 1 part by weight of a phosphorus-containing compound (for example, tetrabutylphosphonium bromide, triphenylbutylphosphonium bromide, or the like) is added as a catalyst, and further, a monomer having a functional group which reacts with an alkyl acrylate polymer or alkyl methacrylate polymer is added to cause reaction, whereby the macromonomer of Structural Formula B is obtained.

Thereafter, a fluorocarbon comb graft polymer may be synthesized using a known technique such as the method disclosed in JP-A No. 58-164656.

For example, the macromonomer of Structural Formula B obtained by the above production method is allowed to react with fluoroalkyl acrylate in a solvent by adding a polymerization initiator, to obtain a fluorocarbon comb graft polymer.

(Purification Method of Fluorocarbon Comb Graft Polymer)

A fluorocarbon comb graft polymer can be purified using a known technique such as a reprecipitation method, a solvent extraction method, an adsorption treatment method using an adsorbent, an insoluble component-removing method by filtration, an insoluble component-removing method by centrifugal separation, or the like.

For example, in the reprecipitation method, a method of causing precipitation by adding dropwise a solution obtained by dissolving a fluorocarbon comb graft polymer in a good solvent such as methyl ethyl ketone into a poor solvent such as methanol, or a method of causing precipitation by adding dropwise a poor solvent such as methanol into a solution obtained by dissolving a fluorocarbon comb graft polymer in a good solvent such as methyl ethyl ketone may be used.

By these purification methods, it is possible to control the concentration of phosphorus in the fluorocarbon comb graft polymer.

A content of fluororesin particles with respect to a total solid content of the charge transporting layer 106 is preferably from 2% by weight to 15% by weight and more preferably from 2% by weight to 12% by weight. When the content of the fluororesin particles with respect to the total solid content of the charge transporting layer 106 is less than 2% by weight, modification of the charge transporting layer 106 by dispersion of the fluororesin particles is insufficient in some cases. Furthermore, when the content exceeds 15% by weight, light transmittance and film strength tend to be deteriorated.

As the fluororesin particles used in the exemplary embodiment, particles of at least one selected from a 4-fluororoethylene resin, a 3-fluorochlorine ethylene resin, a 6-fluoropropylene resin, a fluorovinyl resin, a fluorovinylidiene resin, a 2-fluoro 2-chloroethylene resin, and copolymers thereof are preferably used. Among these, the 4-fluoroethylene resin and fluorovinylidiene resin are particularly preferable.

A particle diameter and molecular weight of the fluororesin particles used in the exemplary embodiment may be freely selected without particular restriction as long as these are within ranges that allows obtaining desired photoreceptor characteristics. A primary particle diameter is preferably 0.05 μm (or about 0.05 μm) or more and 1 μm (or about 1 μm) or less and more preferably 0.1 μm or more and 0.5 μm or less. When the primary particle diameter is smaller than 0.05 μm, flocculation tends to proceed during dispersion. On the other hand, when the primary particle diameter is larger than 1 μm, the image quality tends to be deteriorated.

The charge transporting layer 106 includes, in addition to the foregoing components, a charge transporting material for developing a function intrinsic to the charge transporting layer and a binder resin. Examples of the charge transporting material include, for example, hole transporting materials, for example, an oxadiazole derivative such as 2,5-bis(p-diethylaminophenyl)-1,3,4-oxadiazole, a pyrazoline derivative such as 1,3,5-triphenyl-pyrazoline or 1-[pyridyl-(2)]-3-(p-diethylaminostyryl)-5-(p-diethylaminostyryl)pyrazoline, an aromatic tertiary amino compound such as triphenylamine, N,N'-bis(3,4-dimethylphenyl)biphenyl-4-amine, tri(p-methylphenyl)aminyl-4-amine or dibenzylaniline, an aromatic tertiary diamino compound such as N,N'-bis(3-methylphenyl)-N,N'-diphenyl benzidine, 1,2,4-triazine derivative such as 3-(4'-dimethylaminophenyl)-5,6-di-(4'-methoxyphenyl)-1,2,4-triazine, a hydrazone derivative such as 4-diethylaminobenzaldehyde-1,1-diphenylhydrazone, a quinazoline derivative such as 2-phenyl-4-styryl-quinazoline, a benzofuran derivative such as 6-hydroxy-2,3-di(p-methoxyphenyl) benzofuran, an α-stilbene derivative such as p-(2,2-diphenylvinyl)-N,N'-diphenylaniline, an enamine derivative, a carbazole derivative such as N-ethylcarbazole, or poly-N-vinylcarbazole and a derivative thereof, electron transporting materials such as a quinone compound such as chloranil, or broanthraquinone, a tetracyanoquinodimethane compound, a fluorenone compound such as 2,4,7-trinitrofluorenone or 2,4,5,7-tetranitro-9-fluorenone, a xanthone compound, or a thiophene compound, and a polymer having a group made of the compound in a main chain or a side chain. The charge transporting materials may be used singularly or in a combination of at least two kinds thereof.

Examples of the binder resin in the charge transporting layer 106 include, for example, insulating resins such as a polycarbonate resin such as a bisphenol A type or bisphenol Z type polycarbonate resin, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin or a chlorinated rubber, and organic photoconductive polymers such as polyvinyl carbazole, polyvinyl anthracene or polyvinyl pyrene. The binder resins may be used singularly or in a mixture of at least two kinds thereof.

The charge transporting layer 106 is formed with a coating solution obtained by adding the components in a solvent. Examples of the solvent used to form a charge transporting layer include known organic solvents, for example, aromatic hydrocarbon solvents such as toluene or chlorobenzene; aliphatic alcohol solvents such as methanol, ethanol, n-propanol, iso-propanol or n-butanol; ketone solvents such as acetone, cyclohexanone or 2-butanone; halogenated aliphatic hydrocarbon solvents such as methylene chloride, chloroform or ethylene chloride; cyclic or straight chain ether solvents such as tetrahydrofuran, dioxane, ethylene glycol or diethyl ether; and ester solvents such as methyl acetate, ethyl acetate, or n-butyl acetate. The solvents may be used singularly or in a mixture of at least two kinds thereof. Solvents used for a mixed solvent may be arbitrarily selected from the solvents as long as the mixed solvent may dissolve a binder resin. A blending ratio of a charge transporting material and the binder resin is preferably from 10:1 to 1:5.

Examples of a dispersing device of a coating solution for dispersing fluororesin particles in the charge transporting layer 106 include a media dispersing device such as a ball mill, a vibration ball mill, an attritor, a sand mill, or a horizontal sand mill, and a media-less dispersing device such as a stirrer, an ultrasonic dispersing device, a roll mill, or a high-pressure homogenizer. As the high-pressure homogenizer, a collision type where a dispersion liquid is dispersed by liquid-liquid collision or liquid-wall collision under high pressure and a penetration type where a dispersion liquid is forced to go through fine flow paths under high pressure to disperse are cited.

Examples of a method for coating thus-obtained charge transporting layer forming coating solution on the charge generating layer 105 include usual coating methods including a dip coating method, a push-up coating method, a wire bar coating method, a spray coating method, a blade coating method, a knife coating method and a curtain coating method. A film thickness of the charge transporting layer is set preferably in the range of 5 μm or more and 50 μm or less and more preferably in the range of 10 μm or more and 40 μm or less.

A leveling agent such as silicone oil may be added in a surface layer to improve the flatness of a surface of the charge transporting layer in the exemplary embodiment. The leveling agent may be added in the range that allows obtaining desired characteristics. The leveling agent is used in the charge transporting layer coating solution preferably in the range of 0.1 to 1000 ppm and more preferably in the range of 0.5 to 500 ppm. When the leveling agent is used less than 0.1 ppm, a sufficiently flat surface may not be obtained. On the other hand, when the leveling agent is used exceeding 500 ppm, the residual potential rises when repeatedly used unfavorably from the viewpoint of the electric characteristics.

An additive such as antioxidant, a light stabilizer, or a thermal stabilizer may be added in the respective layers constituting a photosensitive layer 103 for the purpose of inhibiting ozone or nitrogen oxide generated in an electrophotographic apparatus, or light or heat from deteriorating a photoreceptor. Examples of the antioxidant include hindered phenol, hindered amine, paraphenylenediamine, arylalkane, hydroquinone, spirochromane, spiroindanone, and derivatives thereof, organic sulfur compounds, and organic phosphorus compounds. Examples of the light stabilizer include derivatives of benzophenone, benzoazole, dithiocarbamate, and tetramethylpipene.

<Image Forming Apparatus and Process Cartridge>

In the next place, an image forming apparatus and a process cartridge, which involve the exemplary embodiment, will be described.

Figure 2:
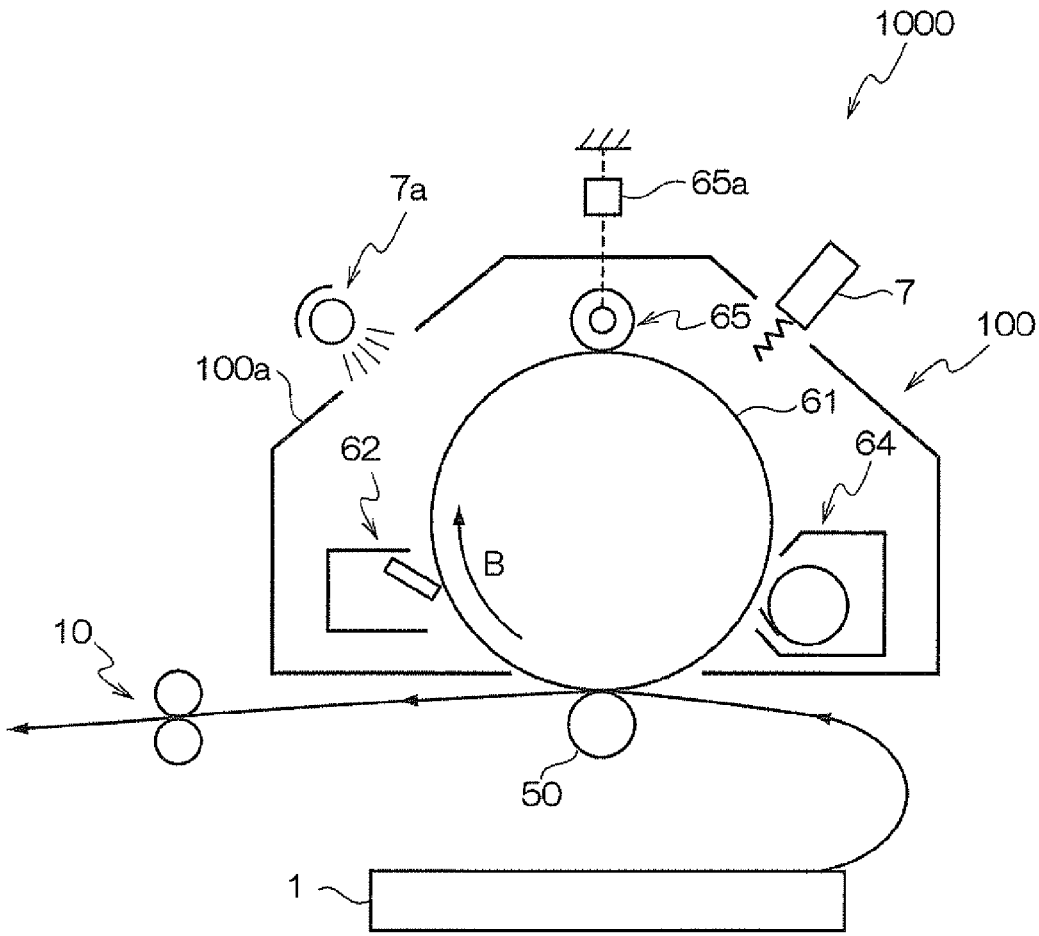
FIG. 2 is an overall configuration diagram showing a first example of an image forming apparatus involving the exemplary embodiment.

FIG. 2 is an overall configurational view showing a first example of an image forming apparatus involving the exemplary embodiment.

The image forming apparatus 1000 is a monochromatic one-side output printer that adopts an electrophotographic process.

The image forming apparatus 1000 includes: a photoreceptor 61 that is an electrophotographic photoreceptor rotating in an arrow mark B direction in the drawing; and a charging member 65 that is a charging unit for charging a photoreceptor surface by receiving a supply of an electric power from a power supply 65*a* to rotate in contact with the photoreceptor 61. Herein, the photoreceptor 61 corresponds to one example of an electrophotographic photoreceptor involving the exemplary embodiment.

Furthermore, the image forming apparatus 1000 includes as well: an exposure portion 7 that is an electrostatic latent image forming unit that emits laser light towards a photoreceptor 61 and forms an electrostatic latent image having a potential higher than the periphery on a surface of the photoreceptor 61; a developing device 64 that is an image forming unit that attaches a monochromatic (black) toner on an electrostatic latent image formed on a surface of the photoreceptor 61 with an electrostatic latent image developing agent containing a black toner to develop the electrostatic latent image to form a toner image; a transfer roll 50 that is a transfer unit for transferring a toner image formed on a surface of the photoreceptor 61 on a paper sheet that is a transfer apparatus by pressing a paper sheet being transported on the photoreceptor 61 on which the toner image is formed; a fixer 10 that is a fixing unit that heats and pressurizes the toner image transferred on the paper sheet to fix the transfer image on the paper sheet; a cleaning device 62 that is a cleaning unit that comes into contact with the photoreceptor 61 to remove residual toner remaining attached on the surface of the photoreceptor 61 after transfer of the toner image; and a deelectrifying lamp 7*a* that removes charges remained on the photoreceptor 61 after transfer of the toner image.

In the image forming apparatus 1000, both the charging member 65 and the photoreceptor 61 are formed in roll extended in a direction vertical to FIG. 2 and both ends of the rolls are supported by a support member 100*a* in a mode where the roll is rotatable. Furthermore, the cleaning device 62 and developing device 64 as well are connected to the support member 100*a*. Thus, the charging member 65, the photoreceptor 61, the cleaning device 62 and the developing device 64 are integrated with the support member 100*a* to constitute a process cartridge 100.

When the process cartridge is incorporated in the image forming apparatus 1000, the respective parts that are constituents of the process cartridge are provided to the image forming apparatus 1000. The process cartridge 100 corresponds to one example of the process cartridge of the exemplary embodiment.

In what follows, an image formation operation in the image forming apparatus 1000 will be described.

The image forming apparatus 1000 includes a not-shown toner cartridge that stores a black toner and the toner cartridge feeds a toner to the developing device 64. A paper sheet on which a toner image is transferred is stored in a paper supply unit 1 and is transported from the paper supply unit 1 at the direction of image formation from a user. Thereafter, the toner image is transferred on the paper sheet in the transfer roll 50 and the paper sheet is transported toward a left direction of the drawing. In FIG. 2, a paper sheet transporting path at this time is shown as a path represented by an arrow mark directed to left. A paper sheet goes through the paper sheet transporting path, and, at a fixing device 10, a transferred image transferred on the paper sheet is fixed, followed by ejecting toward a left direction.

When the charging member 65 charges the photoreceptor 61, a voltage is applied to the charging member 65. As a range of the voltage, a direct current voltage is, in either plus or minus in accordance with a required charging potential of a photoreceptor, preferably 50 V or more and 2000 V or less and more preferably 100 V or more and 1500 V or less. When an alternating-current voltage is superposed, a peak-to-peak voltage is set at 400 V or more and 1800 V or less, preferably at 800 V or more and 1600 V or less, and more preferably at 1200 V or more and 1600 V or less. A frequency of the alternating-current voltage is 50 Hz or more and 20,000 Hz or less and preferably 100 Hz or more and 5,000 Hz or less.

As the charging member 65, one obtained by disposing an elastic layer, a resistance layer or a protective layer on an outer peripheral surface of a core material is preferred. The charging member 65 works as a charging unit when it is brought into contact with the photoreceptor 61 and thereby rotated at a peripheral velocity same as the photoreceptor 61, without particularly supplying a driving unit. However, the charging member 65 may be provided with a driving unit and thereby charged by rotating at a peripheral velocity different from the photoreceptor 61.

As the exposure portion 7, an optical unit that exposes a surface of an electrophotographic photoreceptor desired imagewise with a light source such as a semiconductor laser, an LED (light-emitting diode) or a liquid crystal shutter may be used.

As the developing device 64, an existing developing device that uses a normal or reversal developer such as one-component type or two-component type may be used. A shape of the toner used in the developing device 64 is not particularly limited and may be amorphous, spherical or other particular shape.

As the transfer unit, in addition to a contact charging member such as a transfer roll 50, a contact transfer charging device that uses a belt, a film, or a rubber blade, or a scorotron transfer charging device or a corotron transfer charging device that makes use of corona discharge may be cited.

The cleaning device 62 is used to remove the residual toner attached on a surface of the photoreceptor 61 after transferring. The photoreceptor 61 a surface of which was cleansed therewith is repeatedly supplied to the image formation process. As the cleaning device, other than a cleaning blade, brush cleaning or roll cleaning may be used. Among these, a cleaning blade is preferably used. Examples of a material of the cleaning blade include urethane rubber, neoprene rubber and silicone rubber.

A surface layer of an electrophotographic photoreceptor involving the exemplary embodiment contains fluororesin particles; accordingly, surface energy thereof is low. As the result, when the cleaning blade is used as the cleaning device 62, the surface layer is difficult to cause friction; accordingly, a stable image is formed over a long term.

The image forming apparatus involving the exemplary embodiment is provided with a deelectrifying lamp 7*a*; accordingly, when the photoreceptor 61 is used repeatedly, the residual potential of the photoreceptor 61 is inhibited from carrying over into a next cycle; as the result, image quality is more heightened. In the image forming apparatus involving the exemplary embodiment, as required, a deelectrifying lamp 7*a* may be provided.

Figure 3:
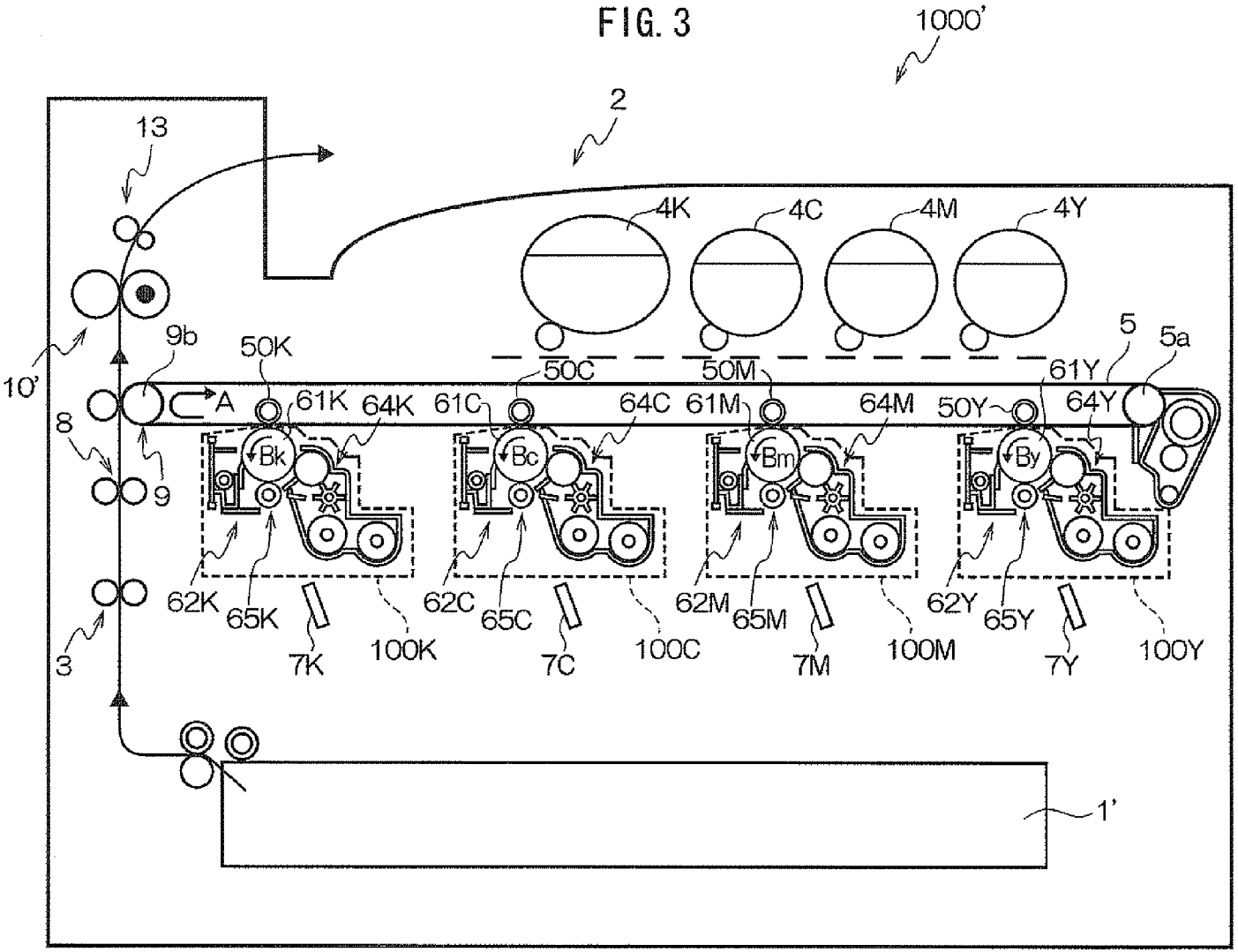
FIG. 3 is an overall configuration diagram showing a second example of an image forming apparatus involving the exemplary embodiment.

FIG. 3 is an overall configurational diagram showing a second example of an image forming apparatus involving the exemplary embodiment.

An image forming apparatus 1000' of the exemplary embodiment is a color printer.

The image forming apparatus 1000' is provided with photoreceptors 61K, 61C, 61M, and 61Y each of which is an electrophotographic photoreceptor that rotates in each of arrow mark directions of Bk, Bc, Bm and By.

Herein, the photoreceptors 61K, 61C, 61M and 61Y correspond to one example of the electrophotographic photoreceptor involving the exemplary embodiment.

In the periphery of each of the photoreceptors, each of the charging members 65K, 65C, 65M and 65Y, which is a charging unit that rotates in contact with each of the photoreceptors and charges a surface of the photoreceptor; each of the exposure portions 7K, 7C, 7M and 7Y, which is an electrostatic latent image forming unit that irradiates laser light and forms an electrostatic latent image of each of colors black (K), cyan (C), magenta (M) and yellow (Y) on each of the charged photoreceptors; and each of developing devices 64K, 64C, 64M and 64Y, which is a developing unit for developing an electrostatic latent image on each of the photoreceptors with an electrostatic latent image developer containing a toner of each of colors to form a toner image of each of colors.

In the image forming apparatus 1000', among the foregoing respective constituents, a charging member 65K, a photoreceptor 61K, a cleaning device 62K and a developing device 64K, all for black, are integrated and form a constituent of a process cartridge 100K. Similarly, a combination of a charging member 65C, a photoreceptor 61C, a cleaning device 62C and a developing device 64C, all for cyan, a combination of a charging member 65M, a photoreceptor 61M, a cleaning device 62M and a developing device 64M, all for magenta, and a combination of a charging member 65Y, a photoreceptor 61Y, a cleaning device 62Y and a developing device 64Y, all for yellow, respectively, are integrated and form constituents of process cartridges 100C, 100M and 100Y. When the four process cartridges are incorporated in the image forming apparatus 1000', the respective portions of the constituents of the process cartridges are incorporated in the image forming apparatus 1000'. Each of the process cartridges 100K, 100C, 100M and 100Y corresponds to one example of the process cartridge of the exemplary embodiment.

Furthermore, the image forming apparatus 1000' includes as well: an intermediate transfer belt 5 that is an intermediate transfer medium that receives transfer (first transfer) of a toner image of each of colors formed on the respective photoreceptors and transports the first transfer image; first transfer rolls 50K, 50C, 50M and 50Y that first-transfers a toner image of each of colors on the intermediate transfer belt 5; a second transfer roll pair 9 that second-transfers on a paper sheet; a fixer 10' that is a fixing unit for fixing a toner image second-transferred on a paper sheet; four toner cartridges 4K, 4C, 4M and 4Y respectively replenishing a toner of each of color components to four developing devices; and a paper sheet feeding unit 1' that stores paper sheets.

Herein, the intermediate transfer belt 5, while receiving a driving force from a driving roll 5*a*, in a state stretched between a second transfer roll 9*b* and a driving roll 5*a*, circularly moves in an arrow mark A direction in the drawing.

In the foregoing description, a case where an intermediate transfer belt 5 is used as an intermediate transfer medium was described. However, the intermediate transfer medium may have a belt shape like the intermediate transfer belt 5 or a drum shape. When the intermediate transfer medium is formed in belt, as a resin material that is used as a base material of the intermediate transfer medium may be an existing resin. Examples of the resin include resinous materials, for example, a polyimide resin, a polycarbonate resin (PC), polyvinylidene fluoride (PVDF), polyalkylene terephthalate (PAT), blends such as ethylene tetrafluoroethylene copolymer (ETFE)/PC, ETFE/PAT and PC/PAT, polyester, polyether ether ketone and polyamide, and resinous materials made with these as a main material. Furthermore, a resinous material and an elastic material may be blended.

In the next place, an operation of image formation in the image forming apparatus 1000' will be described.

Four photoreceptors 61K, 61C, 61M and 61Y, each, are charged by charging members 65K, 65C, 65M and 65Y, and receive laser light irradiated from exposure portions 7K, 7C, 7M and 7Y to form an electrostatic latent image on each of the photoreceptors. Each of the formed electrostatic latent images is developed by each of developing devices 64K, 64C, 64M and 64Y with an electrostatic latent image developer containing a toner of each of colors to form a toner image. Thus formed toner images of the respective colors are sequentially transferred (first-transferred) and superposed in order of yellow (Y), magenta (M), cyan (C) and black (B), on the intermediate transfer belt 5 in the first transfer rolls 50K, 50C, 50M and 50Y corresponding to the respective colors to form a multi-color first transfer image.

Then, the multi-color first-transferred image is transported by the intermediate transfer belt 5 to the pair of second transfer rolls 9. On the other hand, in response to the formation of the multi-color first-transferred image, a paper sheet is taken out of the paper sheet feeding unit 1', followed by transporting by a transporting roll 3, further followed by arranging a position with a pair of positional alignment rolls 8. In the next place, the multi-color first-transferred image is transferred (second-transferred) on the transported paper sheet by the pair of second transfer rolls 9 and the second-transferred image is fixed on the paper sheet by a fixing device 10'. After the fixing, the paper sheet having the fixed image goes past a pair of sending rolls 13 and ejected into an ejected paper receiving part 2.

What was mentioned above is a description of an operation of image formation in the image forming apparatus 1000'.

The process cartridge involving the exemplary embodiment is not particularly limited as long as it includes an electrophotographic photoreceptor involving the exemplary embodiment and is formed freely detachable from the image forming apparatus. That is, the process cartridge may have, in an integrated state, at least one kind selected from a group made of, for example, a charging unit for charging an electrophotographic photoreceptor, an electrostatic latent image forming unit for forming an electrostatic latent image on a charged electrophotographic photoreceptor, a developing unit for developing an electrostatic latent image formed on the electrophotographic photoreceptor as a toner image with an electrostatic latent image developer, a transfer unit for transferring a toner image formed on the electrophotographic photoreceptor on a transfer apparatus, and a cleaning unit for removing a residual toner on the electrophotographic photoreceptor after transfer.

EXAMPLES

In what follows, the exemplary embodiments will be more specifically described with reference to examples and comparative examples. However, the exemplary embodiments are not at all limited to examples shown below.

Example 1

In the first place, 100 parts by weight of zinc oxide (average particle diameter: 70 nm, manufactured by Tayca Co., specific surface area value: 15 $m^2/g$) and 500 parts by weight of methanol are stirred and mixed, 1.25 parts by weight of KBM 603 (trade name, manufactured by Shin-Etsu Chemical Co., Ltd.) are added therein as a silane coupling agent, followed by stirring for 2 hr. Thereafter, methanol is distilled away under reduced pressure, followed by baking at 120° C. for 3 hr, and thereby zinc oxide powder surface-treated with a silane-coupling agent is obtained.

In the next place, 38 parts by weight of a solution obtained by dissolving 60 parts by weight of the surface-treated zinc oxide particles, 0.6 parts by weight of alizarin, 13.5 parts by weight of block isocyanate (trade name: SUMIDULE 3173, manufactured by Sumitomo-Bayer Urethane Co., Ltd.) as a curing agent and 15 parts by weight of a butyral resin (trade name: S-LEC BM-1, manufactured by Sekisui Chemical Co., Ltd.) in 85 parts by weight of methyl ethyl ketone and 25 parts by weight of methyl ethyl ketone are mixed, followed by dispersing for 4 hr with a sand mill with glass beads having a diameter of 1 mm, thereby a dispersion liquid is obtained. To the resulted dispersion liquid, 0.005 parts by weight of dioctyltin dilaurate as a catalyst and 4.0 parts by weight of particles of a silicone resin (trade name: TOSPEARL 145, manufactured by GE-Toshiba Silicone Co., ltd.) are added, thereby an undercoat layer coating solution is obtained. The coating solution is coated on an aluminum base material having a diameter of 30 mm by a dip coating method, followed by drying and curing at 180° C. for 40 min, thereby an undercoat layer having a thickness of 25 μm is obtained.

Then, a mixture containing 15 parts by weight of chlorogallium phthalocyanine crystal having strong diffraction peaks at least at 7.4°, 16.6°, 25.5° and 28.3° by Bragg angle (2θ±0.2°) to Cu Kα characteristic X-ray as a charge generating material, 10 parts by weight of a vinyl chloride-vinyl acetate copolymer resin (trade name: VMCH, manufactured by Union Carbide Corporation, Japan) and 300 parts by weight of n-butyl alcohol is dispersed for 4 hr with a sand mill with glass beads having a diameter of 1 mm, thereby a coating solution for a charge generating layer is obtained. The charge generating layer coating solution is coated by a dip method on the undercoat layer, followed by drying, and thereby a charge generating layer having a thickness of 0.2 μm is obtained.

In the next place, A: 0.5 parts by weight of particles of a tetrafluoroethylene resin (average primary particle diameter: 0.2 μm) and 0.01 parts by weight of a fluorocarbon comb graft polymer containing repeating units represented by the following Structural Formulae (number average molecular weight: 7500, fluorine content: 18% by weight, in the formulae, l=80, m=20, n=40, using the macromonomer synthesized with allyltriphenylphosphonium bromide as a catalyst) are kept at a liquid temperature of 20° C. together with 4 parts by weight of tetrahydrofuran and 1 part by weight of toluene and subjected to stirring and mixing for 48 hr, and thereby, a suspension liquid of particles of tetrafluoroethylene resin is obtained.

Structural Formula A

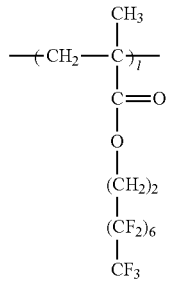

Structural Formula B

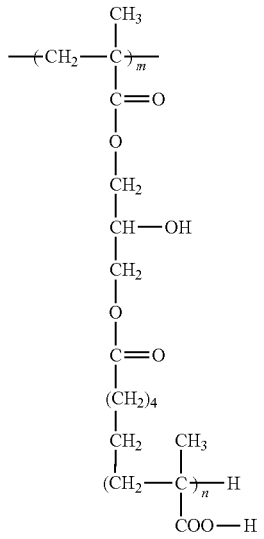

In the next place, B: 2 parts by weight of N,N'-bis(3-methylphenyl)-N,N'-diphenyl benzidine as a charge transporting material, 2 parts by weight of N,N'-bis(3,4-dimethylphenyl)biphenyl-4-amine, 6 parts by weight of a bisphenol Z polycarbonate resin (viscosity average molecular weight: 40,000), 0.1 parts by weight of 2,6-di-t-butyl-4-methylphenol as an antioxidant, 24 parts by weight of tetrahydrofuran and 11 parts by weight of toluene are mixed and dissolved. To the B solution, the A solution is added, followed by stirring and mixing, further followed by repeating 6 times to disperse by pressurizing to 500 $kgf/cm^2$ with a high-pressure homogenizer with a penetrating chamber having fine flow paths (manufactured by Yoshida Kikai Kogyo Co., Ltd.), followed by adding 5 ppm of silicone oil (trade name: KP340, manufactured y Shin-Etsu Chemical Co., Ltd.) to the resulted solution, further followed by thoroughly stirring, and thereby a charge transporting layer forming coating solution is obtained.

The coating solution is coated on the charge generating layer and dried at 115° C. for 40 min, and thereby a charge transporting layer having a film thickness of 32 μm is formed. Thus, an aimed electrophotographic photoreceptor is obtained.

A modified full-color printer Docu Centre Color f450 (trade name, manufactured by Fuji Xerox Co., Ltd.) that incorporates thus-obtained photoreceptor in a drum cartridge is used to conduct a print test where a 50% halftone image is printed on 110,000 sheets of A3 paper sheet (trade name: $C^2$ Paper, manufactured by Fuji Xerox) under an environment of 28° C. and 85% RH, followed by visually evaluating the 10,000-th image. Furthermore, residual potentials on a surface of the electrophotographic photoreceptor before and after the print test are measured and a difference between the residual potential after the first printing and a residual potential after the 10,000-th printing (=the residual potential after the 10,000-th printing–the residual potential after the first printing) is obtained. The obtained results are shown in Table 1. The residual potential is measured by attaching a potential sensor to the modified full-color printer Docu Centre Color f450 (trade name, manufactured by Fuji Xerox Co., Ltd.).

The charge transporting layer peeled off the resulted photoreceptor is dissolved in toluene, followed by filtering with a precision analysis ultrafiltration membrane (manufactured by Millipore Corporation), further followed by adding ultrapure water and shaking for 24 hr with a shaker, and followed by separating aqueous phase. A content of phosphorus contained in the charge transporting layer (surface layer) is obtained by measuring the resulted aqueous phase with a DX-320J ION CHROMATOGRAPHY SYSTEM (trade name, manufactured by Dionex Corporation) that has AS12A as a column and 2.7 mmol/L sodium carbonate solution and 0.3 mmol/L sodium hydrogen carbonate solution as an elution solution on an anion side, and CS 14 as a column and 10 mmol/L methane sulfonate solution as an elution solution on a cation side, and found to be 1 ppm. The phosphorus component is derived from allyltriphenylphosphonium bromide.

Example 2

In a manner similar to Example 1, until a charge generating layer is formed, thereafter, A: 0.5 parts by weight of particles of a tetrafluoroethylene resin (average primary particle diameter: 0.2 μm) and 0.015 parts by weight of a fluorocarbon comb graft polymer containing a repeating unit represented by a Structural Formula below (number average molecular weight: 6000, fluorine content: 13% by weight, in the formula, l=90, m=20, n=60, s=2, using the macromonomer synthesized with tetraphenylphosphonium bromide as a catalyst) are kept at a liquid temperature of 20° C. together with 4 parts by weight of tetrahydrofuran and 1 part by weight of toluene, followed by stirring and mixing for 48 hr, and thereby a suspension liquid of particles of tetrafluoroethylene resin is obtained.

Structural Formula A

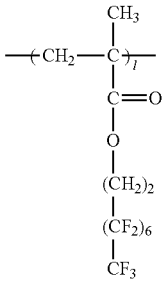

Structural Formula B

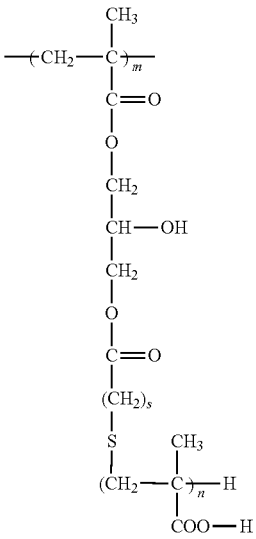

In the next place, B: 2 parts by weight of N,N'-bis(3-methylphenyl)-N,N'-diphenyl benzidine as a charge transporting material, 2 parts by weight of N,N'-bis(3,4-dimethylphenyl)biphenyl-4-amine, 6 parts by weight of a bisphenol Z polycarbonate resin (viscosity average molecular weight: 40,000), 0.1 parts by weight of 2,6-di-t-butyl-4-methylphenol as an antioxidant, 24 parts by weight of tetrahydrofuran and 11 parts by weight of toluene are mixed and dissolved. To the B solution, the A solution is added, followed by stirring and mixing, further followed by repeating dispersing 6 times by pressurizing to 500 kgf/$cm^2$ with a high-pressure homogenizer with a penetrating chamber having fine flow paths (manufactured by Yoshida Kikai Kogyo Co., Ltd.), followed by adding 5 ppm of silicone oil (trade name: KP340, manufactured by Shin-Etsu Chemical Co., Ltd.) to the resulted solution, further followed by thoroughly stirring, and thereby a charge transporting layer forming coating solution is obtained.

The coating solution is coated on the charge generating layer and dried at 115° C. for 40 min, and thereby a charge transporting layer having a film thickness of 32 μm is formed. Thus, an aimed electrophotographic photoreceptor is obtained.

In a manner similar to Example 1, the print test and residual potential measurement are conducted under an environment of 28° C. and 85% RH with a modified full-color printer Docu Centre Color f450 (trade name, manufactured by Fuji Xerox Co., Ltd.) that incorporates thus-obtained photoreceptor in a drum cartridge. The obtained results are shown in Table 1.

Furthermore, in a manner similar to Example 1, a content of phosphorus contained in the charge transporting layer (surface layer) is measured and found to be 2.5 ppm. The phosphorus component is derived from tetraphenylphosphonium bromide.

Example 3

In a manner similar to Example 1, until a charge generating layer is formed, thereafter, A: 0.5 parts by weight of particles of a tetrafluoroethylene resin (average primary particle diameter: 0.2 μm) and 0.015 parts by weight of a fluorocarbon comb graft polymer containing a repeating unit represented by a Structural Formula below (number average molecular weight: 5500, fluorine content: 11% by weight, in the formula, l=60, m=20, n=40, s=2, using the macromonomer synthesized with tributyldodecylphosphonium bromide as a catalyst) are kept at a liquid temperature of 20° C. together with 4 parts by weight of tetrahydrofuran and 1 part by weight of toluene, followed by stirring and mixing for 48 hr, and thereby a suspension liquid of particles of tetrafluoroethylene resin is obtained.

Structural Formula A

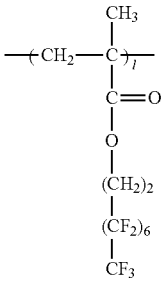

Structural Formula B

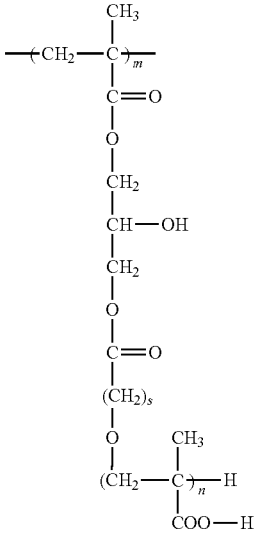

In the next place, B: 2 parts by weight of N,N'-bis(3-methylphenyl)-N,N'-diphenyl benzidine as a charge transporting material, 2 parts by weight of N,N'-bis(3,4-dimethylphenyl)biphenyl-4-amine, 6 parts by weight of a bisphenol Z polycarbonate resin (viscosity average molecular weight: 40,000), 0.1 parts by weight of 2,6-di-t-butyl-4-methylphenol as an antioxidant, 24 parts by weight of tetrahydrofuran and 11 parts by weight of toluene are mixed and dissolved. To the B solution, the A solution is added, followed by stirring and mixing, further followed by repeating dispersing 6 times by pressurizing up to 500 kgf/cm$^2$ with a high-pressure homogenizer with a penetrating chamber having fine flow paths (manufactured by Yoshida Kikai Kogyo Co., Ltd.), followed by adding 5 ppm of silicone oil (trade name: KP340, manufactured y Shin-Etsu Chemical Co., Ltd.) to the resulted solution, further followed by thoroughly stirring, and thereby a charge transporting layer forming coating solution is obtained.

The coating solution is coated on the charge generating layer and dried at 115° C. for 40 min, and thereby a charge transporting layer having a film thickness of 32 μm is formed. Thus, an aimed electrophotographic photoreceptor is obtained.

In a manner similar to Example 1, the print test and residual potential measurement are conducted under an environment of 28° C. and 85% RH with a modified full-color printer Docu Centre Color f450 (trade name, manufactured by Fuji Xerox Co., Ltd.) that incorporates thus-obtained photoreceptor in a drum cartridge. The obtained results are shown in Table 1.

Furthermore, in a manner similar to Example 1, a content of phosphorus contained in the charge transporting layer (surface layer) is measured and found to be 4 ppm. The phosphorus component is derived from tributyldodecylphosphonium bromide.

Example 4

In a manner similar to Example 1, until a charge generating layer is formed, thereafter, A: 0.5 parts by weight of particles of a tetrafluoroethylene resin (average primary particle diameter: 0.2 μm) and 0.015 parts by weight of a fluorocarbon comb graft polymer containing a repeating unit represented by a Structural Formula below (number average molecular weight: 7000, fluorine content: 14% by weight, in the formula, l=90, m=20, n=60, using the macromonomer synthesized with tetrabutylphosphonium bromide as a catalyst) are kept at a liquid temperature of 20° C. together with 4 parts by weight of tetrahydrofuran and 1 part by weight of toluene, followed by stirring and mixing for 48 hr, and thereby a suspension liquid of particles of tetrafluoroethylene resin is obtained.

Structural Formula A

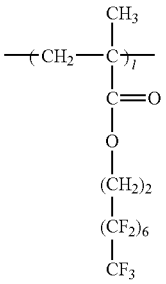

-continued

Structural Formula B

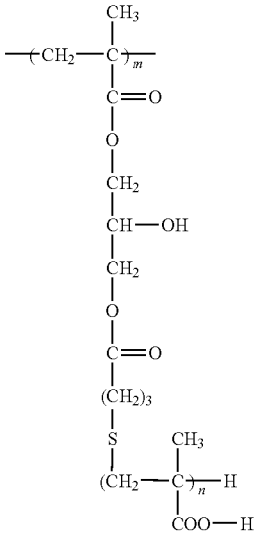

In the next place, B: 2 parts by weight of N,N'-bis(3-methylphenyl)-N,N'-diphenyl benzidine as a charge transporting material, 2 parts by weight of N,N'-bis(3,4-dimethylphenyl)biphenyl-4-amine, 6 parts by weight of a bisphenol Z polycarbonate resin (viscosity average molecular weight: 40,000), 0.1 parts by weight of 2,6-di-t-butyl-4-methylphenol as an antioxidant, 24 parts by weight of tetrahydrofuran and 11 parts by weight of toluene are mixed and dissolved. To the B solution, the A solution is added, followed by stirring and mixing, further followed by repeating dispersing 6 times by pressurizing up to 500 kgf/cm$^2$ with a high-pressure homogenizer with a penetrating chamber having fine flow paths (manufactured by Yoshida Kikai Kogyo Co., Ltd.), followed by adding 5 ppm of silicone oil (trade name: KP340, manufactured y Shin-Etsu Chemical Co., Ltd.) to the resulted solution, further followed by thoroughly stirring, and thereby a charge transporting layer forming coating solution is obtained.

The coating solution is coated on the charge generating layer and dried at 115° C. for 40 min, and thereby a charge transporting layer having a film thickness of 32 μm is formed. Thus, an aimed electrophotographic photoreceptor is obtained.

In a manner similar to Example 1, the print test and residual potential measurement are conducted under an environment of 28° C. and 85% RH with a modified full-color printer Docu Centre Color f450 (trade name, manufactured by Fuji Xerox Co., Ltd.) that incorporates thus-obtained photoreceptor in a drum cartridge. The obtained results are shown in Table 1.

Furthermore, in a manner similar to Example 1, a content of phosphorus contained in the charge transporting layer (surface layer) is measured and found to be 2 ppm. The phosphorus component is derived from tetrabutylphosphonium bromide.

Example 5

In a manner similar to Example 1, until a charge generating layer is formed, thereafter, A: 0.5 parts by weight of particles of a tetrafluoroethylene resin (average primary particle diameter: 0.2 μm) and 0.01 parts by weight of a polymer (number average molecular weight: 20000, fluorine content: 21% by weight, in the formula, l=200, m=40, n=40, using the macromonomer synthesized with allyltriphenylphosphonium bromide as a catalyst) having a structure similar to a fluorocarbon comb graft polymer used in Example 1 are kept at a liquid temperature of 20° C. together with 4 parts by weight of tetrahydrofuran and 1 part by weight of toluene, followed by stirring and mixing for 48 hr, and thereby a suspension liquid of particles of tetrafluoroethylene resin is obtained.

In the next place, B: 2 parts by weight of N,N'-bis(3-methylphenyl)-N,N'-diphenyl benzidine as a charge transporting material, 2 parts by weight of N,N'-bis(3,4-dimethylphenyl)biphenyl-4-amine, 6 parts by weight of a bisphenol Z polycarbonate resin (viscosity average molecular weight: 40,000), 0.1 parts by weight of 2,6-di-t-butyl-4-methylphenol as an antioxidant, 24 parts by weight of tetrahydrofuran and 11 parts by weight of toluene are mixed and dissolved. To the B solution, the A solution is added, followed by stirring and mixing, further followed by repeating dispersing 6 times by pressurizing up to 500 kgf/cm$^2$ with a high-pressure homogenizer with a penetrating chamber having fine flow paths (manufactured by Yoshida Kikai Kogyo Co., Ltd.), followed by adding 5 ppm of silicone oil (trade name: KP340, manufactured y Shin-Etsu Chemical Co., Ltd.) to the resulted solution, further followed by thoroughly stirring, and thereby a charge transporting layer forming coating solution is obtained.

The coating solution is coated on the charge generating layer and dried at 115° C. for 40 min, and thereby a charge transporting layer having a film thickness of 32 μm is formed. Thus, an aimed electrophotographic photoreceptor is obtained.

In a manner similar to Example 1, the print test and residual potential measurement are conducted under an environment of 28° C. and 85% RH with a modified full-color printer Docu Centre Color f450 (trade name, manufactured by Fuji Xerox Co., Ltd.) that incorporates thus-obtained photoreceptor in a drum cartridge. The obtained results are shown in Table 1.

Furthermore, in a manner similar to Example 1, a content of phosphorus contained in the charge transporting layer (surface layer) is measured and found to be 1.5 ppm. The phosphorus component is derived from allyltriphenylphosphonium bromide.

Example 6

In a manner similar to Example 1, until a charge generating layer is formed, thereafter, A: 0.5 parts by weight of particles of a tetrafluoroethylene resin (average primary particle diameter: 0.2 μm) and 0.03 parts by weight of a polymer (number average molecular weight: 4500, fluorine content: 10% by weight, in the formula, l=20, m=10, n=40, using the macromonomer synthesized with allyltriphenylphosphonium bromide as a catalyst) having a structure similar to a fluorocarbon comb graft polymer used in Example 1 are kept at a liquid temperature of 20° C. together with 4 parts by weight of tetrahydrofuran and 1 part by weight of toluene, followed by stirring and mixing for 48 hr, and thereby a suspension liquid of particles of tetrafluoroethylene resin is obtained.

In the next place, B: 2 parts by weight of N,N'-bis(3-methylphenyl)-N,N'-diphenyl benzidine as a charge transporting material, 2 parts by weight of N,N'-bis(3,4-dimethylphenyl)biphenyl-4-amine, 6 parts by weight of a bisphenol Z polycarbonate resin (viscosity average molecular weight: 40,000), 0.1 parts by weight of 2,6-di-t-butyl-4-methylphenol as an antioxidant, 24 parts by weight of tetrahydrofuran and 11 parts by weight of toluene are mixed and dissolved. To the B solution, the A solution is added, followed by stirring and mixing, further followed by repeating dispersing 6 times by pressurizing up to 500 kgf/cm$^2$ with a high-pressure homogenizer with a penetrating chamber having fine flow paths (manufactured by Yoshida Kikai Kogyo Co., Ltd.), followed by adding 5 ppm of silicone oil (trade name: KP340, manufactured by Shin-Etsu Chemical Co., Ltd.) to the resulted solution, further followed by thoroughly stirring, and thereby a charge transporting layer forming coating solution is obtained.

The coating solution is coated on the charge generating layer and dried at 115° C. for 40 min, and thereby a charge transporting layer having a film thickness of 32 μm is formed. Thus, an aimed electrophotographic photoreceptor is obtained.

In a manner similar to Example 1, the print test and residual potential measurement are conducted under an environment of 28° C. and 85% RH with a modified full-color printer Docu Centre Color f450 (trade name, manufactured by Fuji Xerox Co., Ltd.) that incorporates thus-obtained photoreceptor in a drum cartridge. The obtained results are shown in Table 1.

Furthermore, in a manner similar to Example 1, a content of phosphorus contained in the charge transporting layer (surface layer) is measured and found to be 1 ppm. The phosphorus component is derived from allyltriphenylphosphonium bromide.

Example 7

In a manner similar to Example 1, until a charge generating layer is formed, thereafter, A: 0.5 parts by weight of particles of a tetrafluoroethylene resin (average primary particle diameter: 0.2 μm) and 0.01 parts by weight of a polymer (number average molecular weight 23000, fluorine content: 25% by weight, in the formula, l=260, m=40, n=40, using the macromonomer synthesized with allyltriphenylphosphonium bromide as a catalyst) having a structure similar to the fluorocarbon comb graft polymer used in Example 1 are kept together with 4 parts by weight of tetrahydrofuran and 1 part by weight of toluene at a liquid temperature of 20° C., followed by stirring and mixing for 48 hr, and thereby a suspension liquid of particles of tetrafluoroethylene resin is obtained.

In the next place, B: 2 parts by weight of N,N'-bis(3-methylphenyl)-N,N'-diphenyl benzidine as a charge transporting material, 2 parts by weight of N,N'-bis(3,4-dimethylphenyl)biphenyl-4-amine, 6 parts by weight of a bisphenol Z polycarbonate resin (viscosity average molecular weight: 40,000), 0.1 parts by weight of 2,6-di-t-butyl-4-methylphenol as an antioxidant, 24 parts by weight of tetrahydrofuran and 11 parts by weight of toluene are mixed and dissolved. To the B solution, the A solution is added, followed by stirring and mixing, her followed by repeating dispersing 6 times by pressurizing up to 500 kgf/cm$^2$ with a high-pressure homogenizer with a penetrating chamber having fine flow paths (manufactured by Yoshida Kikai Kogyo Co., Ltd.), followed by adding 5 ppm of silicone oil (trade name: KP340, manufactured y Shin-Etsu Chemical Co., Ltd.) to the resulted solution, further followed by thoroughly stirring, and thereby a charge transporting layer forming coating solution is obtained.

The coating solution is coated on the charge generating layer and dried at 115° C. for 40 min, and thereby a charge transporting layer having a film thickness of 32 μm is formed. Thus, an aimed electrophotographic photoreceptor is obtained.

In a manner similar to Example 1, the print test and residual potential measurement are conducted under an environment of 28° C. and 85% RH with a modified full-color printer Docu Centre Color f450 (trade name, manufactured by Fuji Xerox Co., Ltd.) that incorporates thus-obtained photoreceptor in a drum cartridge. The obtained results are shown in Table 1.

Furthermore, in a manner similar to Example 1, a content of phosphorus contained in the charge transporting layer (surface layer) is measured and found to be 1.5 ppm. The phosphorus component is derived from allyltriphenylphosphonium bromide.

Comparative Example 1

In a manner similar to Example 1, until a charge generating layer is formed, thereafter, A: 0.5 parts by weight of particles of a tetrafluoroethylene resin (average primary particle diameter: 0.2 μm) and 0.01 parts by weight of a polymer (number average molecular weight: 9000, fluorine content: 19% by weight, in the formula, l=80, m=15, n=40, using the macromonomer synthesized with allyltriphenylphosphonium bromide as a catalyst) having a structure similar to the fluorocarbon comb graft polymer used in Example 1 are kept together with 4 parts by weight of tetrahydrofuran and 1 part by weight of toluene at a liquid temperature of 20° C., followed by stirring and mixing for 48 hr, and thereby a suspension liquid of particles of tetrafluoroethylene resin is obtained.

In the next place, B: 2 parts by weight of N,N'-bis(3-methylphenyl)-N,N'-diphenyl benzidine as a charge transporting material, 2 parts by weight of N,N'-bis(3,4-dimethylphenyl)biphenyl-4-amine, 6 parts by weight of a bisphenol Z polycarbonate resin (viscosity average molecular weight: 40,000), 0.1 parts by weight of 2,6-di-t-butyl-4-methylphenol as an antioxidant, 24 parts by weight of tetrahydrofuran and 11 parts by weight of toluene are mixed and dissolved. To the B solution, the A solution is added, followed by stirring and mixing, further followed by repeating dispersing 6 times by pressurizing up to 500 kgf/cm$^2$ with a high-pressure homogenizer with a penetrating chamber having fine flow paths (manufactured by Yoshida Kikai Kogyo Co., Ltd.), followed by adding 5 ppm of silicone oil (trade name: KP340, manufactured y Shin-Etsu Chemical Co., Ltd.) to the resulted solution, further followed by thoroughly stirring, and thereby a charge transporting layer forming coating solution is obtained.

The coating solution is coated on the charge generating layer and dried at 115° C. for 40 min, and thereby a charge transporting layer having a film thickness of 32 μm is formed. Thus, an aimed electrophotographic photoreceptor is obtained.

In a manner similar to Example 1, the print test and residual potential measurement are conducted under an environment of 28° C. and 85% RH with a modified full-color printer Docu Centre Color f450 (trade name, manufactured by Fuji Xerox Co., Ltd.) that incorporates thus-obtained photoreceptor in a drum cartridge. The obtained results are shown in Table 1.

Furthermore, a content of phosphorus contained in the charge transporting layer (surface layer) is measured and found to be 7 ppm. The phosphorus component is derived from allyltriphenylphosphonium bromide.

Reference Example

A charge transporting layer forming coating solution is produced in a manner similar to Example 1 except that, in Example 1, ARON GF300 (trade name, manufactured by Toagosei Co., Ltd.) purified by re-precipitating from methanol is used as the fluorocarbon comb graft polymer, and thereby an electrophotographic photoreceptor is obtained.

The resulted photoreceptor is evaluated in a manner similar to Example 1. Obtained results are shown in Table 1.

A content of an ammonium salt contained in the charge transporting layer (surface layer) is measured and found to be 2 ppm.

TABLE 1

| | Residual Potential Difference After 10000 Sheets Print Test (Under Environment of 28° C. and 85% RH) | Print Test (Half Tone 10000-th Sheet) |
|---|---|---|
| Example 1 | Rise in residual potential: 5 V | No density lowering |
| Example 2 | Rise in residual potential: 15 V | No density lowering |
| Example 3 | Rise in residual potential: 10 V | No density lowering |
| Example 4 | Rise in residual potential: 25 V | No density lowering |
| Example 5 | Rise in residual potential: 15 V | No density lowering |
| Example 6 | Rise in residual potential: 10 V | No density lowering |
| Example 7 | Rise in residual potential: 15 V | No density lowering |
| Comparative Example 1 | Rise in residual potential: 100 V | Density lowering |
| Reference Example | Rise in residual potential: 80 V | Density lowering |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising at least a photosensitive layer on a conductive support, the photosensitive layer having a surface layer, the surface layer comprising:

fluororesin particles, and a fluorocarbon comb graft polymer including a repeating unit derived from a monomer having a fluoroalkyl group having 1 to 8 carbon atoms and a repeating unit derived from a macromonomer produced using a phosphonium salt compound, wherein the surface layer contains phosphorus in an amount from 1 ppm to 5 ppm, the phosphorus being derived from the phosphonium salt compound used to produce the macromonomer.

2. The electrophotographic photoreceptor of claim 1, wherein the macromonomer comprises a polymer or a copolymer of an acrylic acid ester, a methacrylic acid ester, or a styrene compound.

3. The electrophotographic photoreceptor of claim 1, wherein the phosphonium salt compound is selected from the group consisting of a triphenylphosphonium salt compound, a tetraphenylphosphonium salt compound, a tributylphosphonium salt compound, and a tetrabutylphosphonium salt compound.

4. The electrophotographic photoreceptor of claim 1, wherein a content of fluorine in the fluorocarbon comb graft polymer is from 10% by weight to 40% by weight.

5. The electrophotographic photoreceptor of claim 1, wherein a content of fluorine in the fluorocarbon comb graft polymer is from 10% by weight to 30% by weight.

6. The electrophotographic photoreceptor of claim 1, wherein a number average molecular weight of the fluorocarbon comb graft polymer is from 5,000 to 20,000.

7. The electrophotographic photoreceptor of claim 1, wherein a number average molecular weight of the fluorocarbon comb graft polymer is from 6,000 to 15,000.

8. The electrophotographic photoreceptor of claim 1, wherein the fluorocarbon comb graft polymer is contained in an amount of 0.5% by weight to 5% by weight with respect to a weight of the fluororesin particles.

9. The electrophotographic photoreceptor of claim 1, wherein the fluorocarbon comb graft polymer contains a repeating unit represented by the following Structural Formula A and a repeating unit represented by the following Structural Formula B:

Structural Formula A

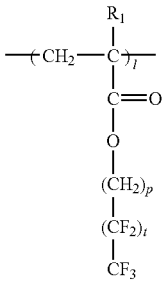

Structural Formula B

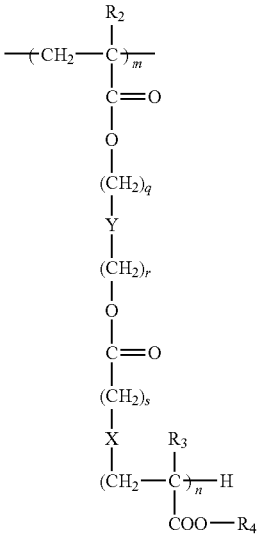

wherein in Structural Formulae A and B, l, m, and n each independently represent an integer of 1 or more;

p, q, r, and s each independently represent 0 or an integer of 1 or more;

t represents an integer of 1 to 7;

$R_1$, $R_2$, $R_3$, and $R_4$ each independently represent a hydrogen atom or an alkyl group;

X represents an alkylene group, a halogen-substituted alkylene group, —S—, —O—, —NH—, or a single bond;

Y represents an alkylene group, a halogen-substituted alkylene group, —($C_zH_{2z-1}$(OH))—or a single bond; and z represents an integer of 1 or more.

10. A process cartridge that is detachably attached to an image forming apparatus and comprises the electrophotographic photoreceptor of claim 1.

11. An image forming apparatus comprising:

the electrophotographic photoreceptor of claim 1;

a developing unit that develops an electrostatic latent image formed on the electrophotographic photoreceptor with an electrostatic latent image developer to form a toner image;

a transfer unit that transfers the toner image formed on the electrophotographic photoreceptor onto a receiving body; and a fixing unit that fixes the transferred toner image on the receiving body.

12. The image forming apparatus of claim 11, wherein a content of fluorine in the fluorocarbon comb graft polymer is from 10% by weight to 40% by weight.

13. The image forming apparatus of claim 11, wherein the fluorocarbon comb graft polymer contains a repeating unit represented by the following Structural Formula A and a repeating unit represented by the following Structural Formula B:

Structural Formula A

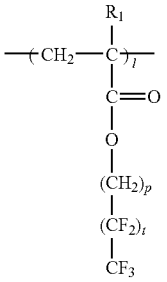

-continued

Structural Formula B

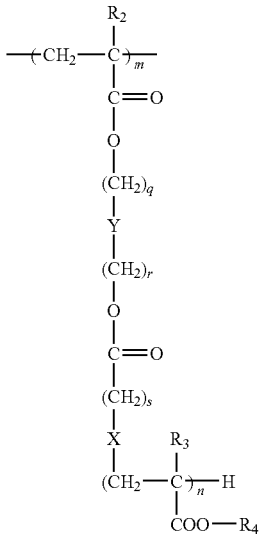

wherein in Structural Formulae A and B, l, m, and n each independently represent an integer of 1 or more;

p, q, r, and s each independently represent 0 or an integer of 1 or more;

t represents an integer of 1 to 7;

$R_1$, $R_2$, $R_3$, and $R_4$ each independently represent a hydrogen atom or an alkyl group;

X represents an alkylene group, a halogen-substituted alkylene group, —S—, —O—, —NH—, or a single bond;

Y represents an alkylene group, a halogen-substituted alkylene group, —($C_zH_{2z-1}$(OH))—or a single bond; and z represents an integer of 1 or more.

14. The electrophotographic photoreceptor of claim 1, wherein the surface layer comprises the phosphorus derived from the phosphonium salt compound in an amount of from 1 ppm to 4 ppm.

* * * * *